United States Patent [19]

Verasani et al.

[11] Patent Number: 4,980,946

[45] Date of Patent: Jan. 1, 1991

[54] JOINTED FITTING FOR A SWING FRAME OF A DOOR, WINDOW OR THE LIKE

[75] Inventors: André Verasani, Amfreville La Campagne; Daniel Vigreux, Biberkirch, both of France

[73] Assignee: Ferco International Usine de Ferrures de Batiment, Sarrebourg, France

[21] Appl. No.: 430,980

[22] Filed: Nov. 1, 1989

Related U.S. Application Data

[63] Continuation of Ser. No. 187,901, Apr. 29, 1988, abandoned.

[30] Foreign Application Priority Data

May 5, 1987 [FR] France ..... 8706444

[51] Int. Cl.[5] ..... E05D 7/00

[52] U.S. Cl. ..... 16/224; 16/231; 16/235; 16/249; 16/272; 16/382; 16/388; 16/366; 16/DIG. 43

[58] Field of Search ..... 16/231, 224, 235, 249, 16/272, 366, 371, 382, 386, 387, 388, DIG. 43

[56] References Cited

FOREIGN PATENT DOCUMENTS 1459011 5/1969 Fed. Rep. of Germany ..... 49/192
2405620 8/1975 Fed. Rep. of Germany .
2210217 7/1974 France .
2214316 8/1974 France .
2269626 11/1975 France .
2275626 2/1976 France ..... 49/192

OTHER PUBLICATIONS

Ferco; "Ferrur Jet Ak Pour Chassis Osillo-Battants" advertising brochure, 4 pages.
Ferco; "Turn-Tilt Gear Aljut Aluminium Joinery" advertising brochure, 8 pages.
Ferco; "Fitting for Tilt-Turn Gears Jat as 130-Aluminium Joinery", advertising brochure; 12 pages.

*Primary Examiner*—Richard K. Seidel
*Assistant Examiner*—Edward A. Brown
*Attorney, Agent, or Firm*—Sandler, Greenblum & Bernstein

[57] ABSTRACT

Jointed fitting for a swing door, window or the like, designed in metal or plastic material and the movable frame whereof is partially overlapping the fixed frame, consisting of an angular support and of a compass bearing. The latter are embodied in a symmetric manner in relation to a median horizontal plane, allowing for their reversibility in view of being used either right or left of the movable frame, with this angular support and this compass bearing comprising, furthermore, means designed for fillister and applied fastening to the fixed frame.

15 Claims, 4 Drawing Sheets

JOINTED FITTING FOR A SWING FRAME OF A DOOR, WINDOW OR THE LIKE

This application is a continuation of application Ser. No. 07/187,901, filed Apr. 29, 1988, now abandoned.

BACKGROUND OF THE INVENTION

1. Field of the Invention

The present invention relates to a jointed fitting for a swing door, window or the like, designed in metal or in plastic material profile and the movable frame whereof partially overlaps the fixed frame.

This invention will be useful, more particularly, in the field of hardware for the building industry.

2. The Prior Art

We already know of swings door or window joints that consist normally of two separate elements, one of which, referred to as a compass bearing, constitutes the upper link of the movable frame with the fixed frame, and the other element of which, referred to as an angular support, provides the lower link of this movable frame with the fixed frame.

Apart from the position occupied in relation to the door or the window, the functions assigned to this angular support and to the compass bearing will differ. Thus, the angular support allows, at the same time, allows the movable frame to rotate around a vertical axis passing through its rear narrow side, and a rotation around a horizontal axis that may be materialized roughly by the bottom crossbar of the fixed frame. In comparison, the compass bearing provides for the rotation of the compass around a vertical axis, which compass, because of its linkage to the movable frame, passes this rotation on to the latter. This compass also provides for a limited tilt of the movable frame when the latter revolves around the horizontal axis.

However, the angular support and the compass bearing have a common function that supports the weight of the movable frame and provides, for the perfect positioning of the latter in relation to the fixed frame of the door or window.

Thus, the angular support and the compass bearing consist, generally, of a fixed element fitted solidly to the fixed frame and of a jointed part attached directly or via the arm of the compass to the movable frame. To enable these joints to function as a support for the movable frame, it is absolutely necessary that both the fixed element and the jointed part of the aforesaid fittings be attached solidly, respectively to the fixed frame and to the movable frame. Furthermore, the linkage between the fixed element and the jointed part of the angular support and of the compass bearing has to be determined according to the stress that will be applied on them.

The major problem regarding these joints for a swing door or window arises from the difficulties encountered in fitting them to the uprights of the fixed frame or of the movable frame. These difficulties are increased when the door, window or the like is designed from tubular profiles made of a light material such as aluminum or plastic material.

As a matter of fact, the fitting of the angular support and of the compass bearing to an upright of the fixed frame requires, generally, machining that tends to locally weaken the latter. This machining is separate for one and for the other joint and it causes a considerable loss of time, either in making the door, window or the like, or at the time when the latter is being assembled.

Obviously, where a movable frame partially overlapping the fixed frame is concerned, the methods used for fitting these joints become more sophisticated, considering that a simple application to the inner face area of the door or window is not desirable, in particular as regards the attractiveness of the entire unit.

Thus, in this case, two solutions are normally chosen. The first solution consists in fitting the angular support and the compass bearing in the fillister of the movable frame and of the fixed frame, with all the machining and tightness drawbacks involved. This solution is applicable only for movable frames of low weight because of the poor mechanical resistance of these joints so as to decrease their size to a minimum.

The second solution in providing the linkage of these joints in the fillister of the movable frame and of the fixed frame while preserving their applied position. This solution is usually referred to by the users by adding the words "for clamping" to the name of the fitting concerned.

More specifically, such a method consists of connecting to the fixed element and to the movable part of the joint a wing bent in the form of a square that fits between the border of the movable frame that forms the overlapping of the fixed frame, and the inner face of the latter. This wing cooperates, furthermore, with the narrow side of the fixed frame via appropriate fastening means.

As a rule, the profiles used for designing a door or window confer on the movable frame and on the fixed frame a T-shaped groove located on their horizontal and vertical narrow sides. Thus, the aforesaid fastening means normally consist of elements liable to co-operate with this groove for providing the linkage of the joint without requiring any machining. More accurately, they consist of wedges fitted into the groove so that they can not become released and in which openings are made that are able to accept fastening elements such as bolts or rivets.

Just as above, the joints provided with this type of linkage display an inadequate mechanical resistance for supporting the heavier weight of a movable frame and, for this reason, they are limited to a restricted range of products. Furthermore, because of their complicated nature, these joints are currently designed for being used either on the left or on the right. Thus, it is necessary to dinstiguish the angular supports and the compass bearings that can be fitted on the left side of a door, window or the like from those designed for being used on the right side. This drawback makes it necessary to handle four different productions in parallel. Furthermore, stock management becomes more difficult.

In addition, when a swing-type door, window or the like is to be restored, the original fittings can be replaced, generally, by strictly identical fittings only. As a matter of fact, the holes machined previously in the fixed frame will fit in most of the cases, fitting designs supplied by one specific manufacturer only. This can cause numerous difficulties for users who try to obtain these fittings when the manufacturer has ceased to make them. Also, professionals specialized in installing and restoring doors, windows and the like will have to keep an inventory of a large number of different fittings supplied by several manufacturers.

SUMMARY OF THE INVENTION

It is the object of the present invention to provide a solution for all of the aforesaid drawbacks by proposing a jointed fitting for a swing door, window or the like, consisting of an angular support and of a compass bearing that are both symmetric in relation to a horizontal median plane, which symmetry allows for their reversibility and improves their mechanical resistance.

Moreover, this angular support and this compass bearing consist of a jointed part fitted to the movable frame or serving as a support for the compass arm, and of a fixed element fitted solidly to the fixed frame, with this element comprising, simultaneously, means for fillister-fastening to the fixed frame and means for applied fastening to the inner face of the latter.

This link following two directions perpendicular to the angular support and the compass bearing with the fixed frame, provides for the possibility of applying onto them a much greater load as compared to joints known up to now.

Another object of the present invention consists in achieving standardization of the manufacturing process and of the supply material used for executing the fitting, by proposing a compass bearing and an angular support of similar structure and made from identical profiles.

Moreover, the fitting according to the invention displays the interesting feature of avoiding on one hand, differing machining operations in the upper section as compared to the lower section of the movable frame and of the fixed frame and, on the other hand, of restricting these machining operations to a minimum.

For this purpose, the present invention concerns a jointed fitting for a swing door, window or the like, designed in metal or plastic material and the movable frame whereof is partly overlapping the fixed frame, with this fitting consisting of an angular support and of a compass bearing that are both symmetric in relation to a horizontal median plane, allowing for their reversibility in view of being used either right or left, and comprising a fixed element fitted firmly to the fixed frame and a jointed part fitted to the movable frame or serving as a support to the compass arm, with the fixed element comprising means designed for fillister-fastening to the fixed frame and for applied fastening to the inner face of the latter.

The invention is described below in greater detail by means of drawings that are showing one form of embodiment only.

THE DRAWINGS

DESCRIPTION OF THE PREFERRED EMBODIMENTS

Figure 1:
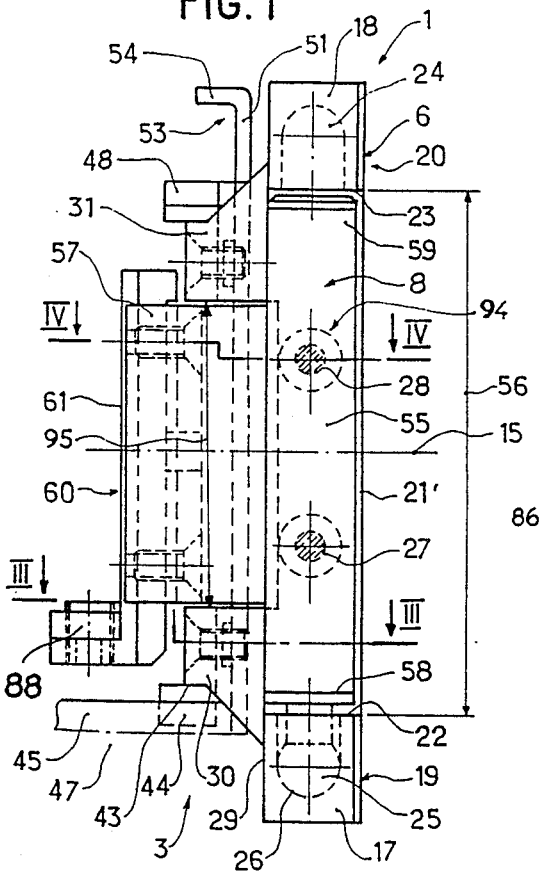
FIG. 1 is an elevational view of an angular support according to the invention.
Figure 2:
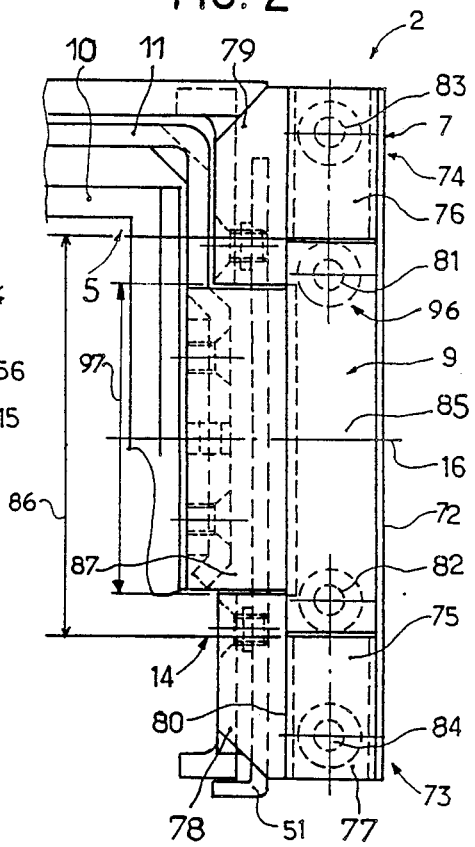
FIG. 2 is an elevational view of a compass bearing according to the invention.
Figure 3:
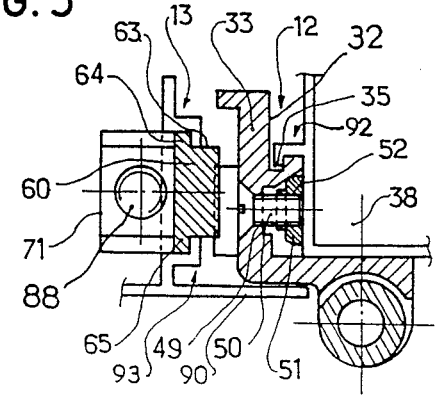
FIG. 3 is a section taken along the line III—III of FIG. 1.
Figure 4:
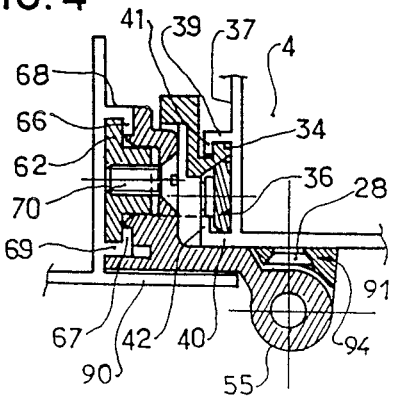
FIG. 4 is a section taken along the line IV—IV of FIG. 1.
Figure 5:
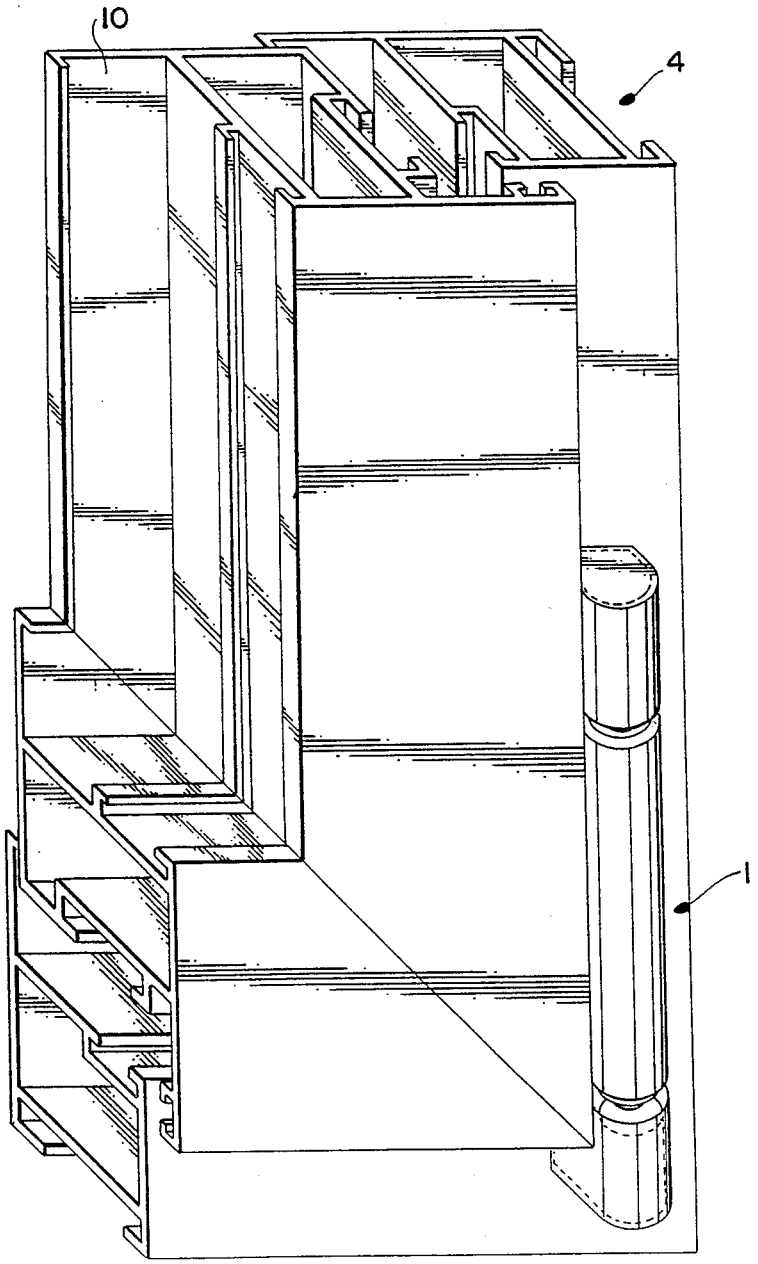
FIG. 5 is a perspective view of the fixed frame and movable frame in the closed position.
Figures 6, 7:
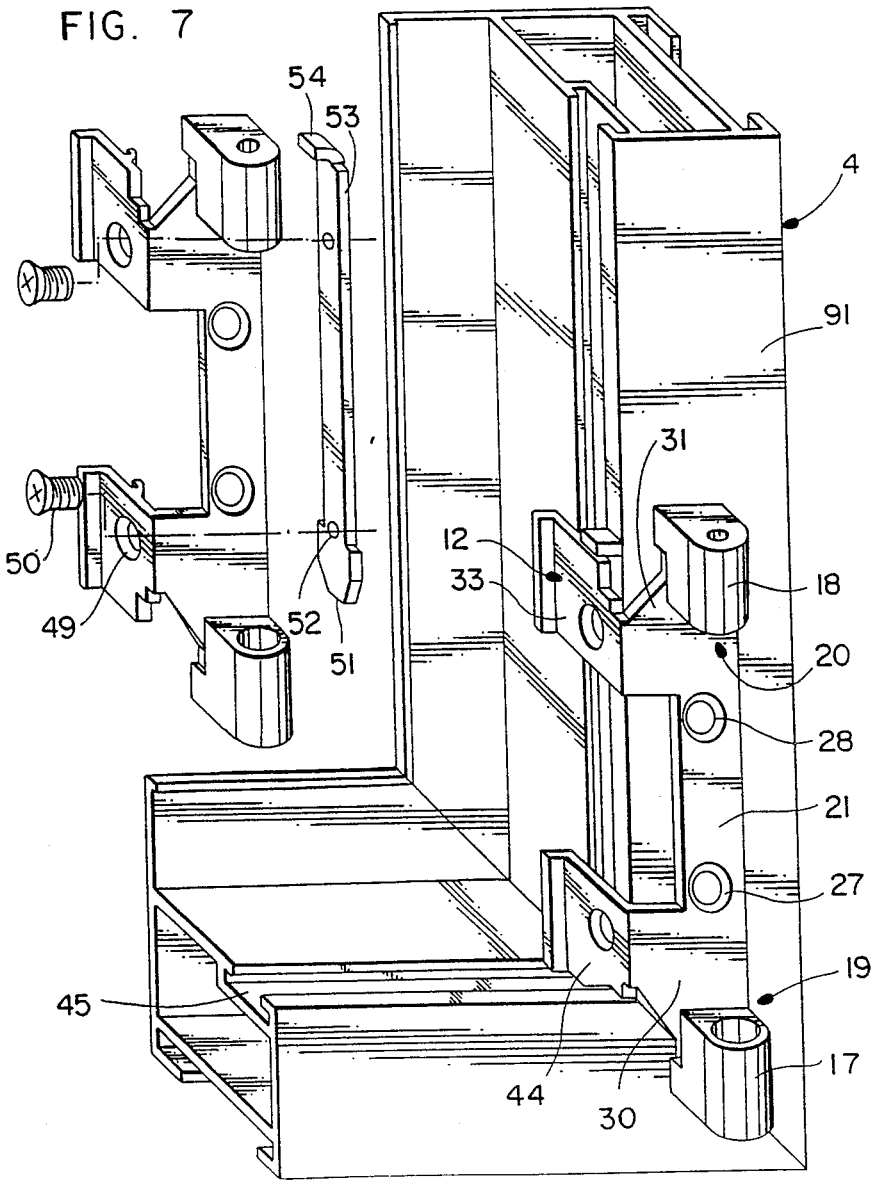
FIG. 6 is a perspective view of the fixed element of the angular support attached to the fixed frame.
FIG. 7 is an exploded view of the fixed element.
Figure 8:
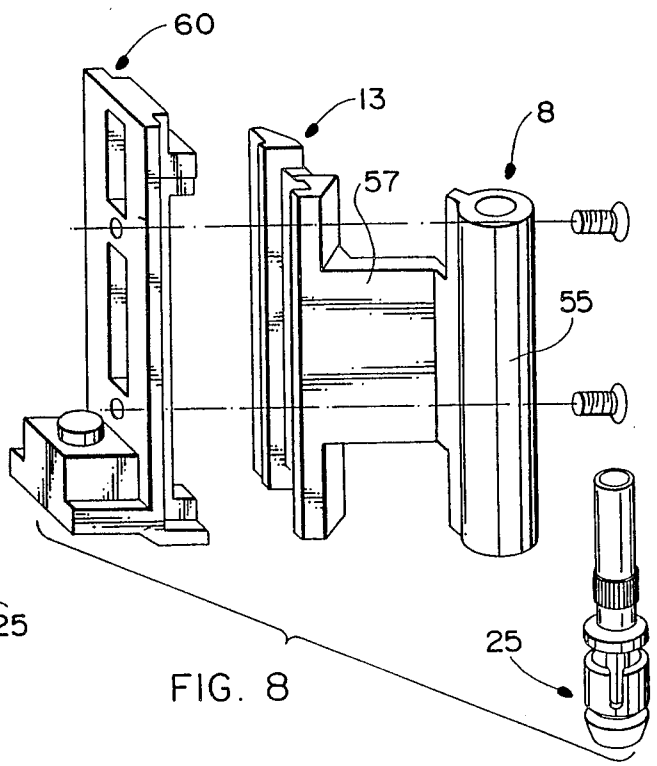
FIG. 8 is an exploded view of the jointed part.
Figure 9:
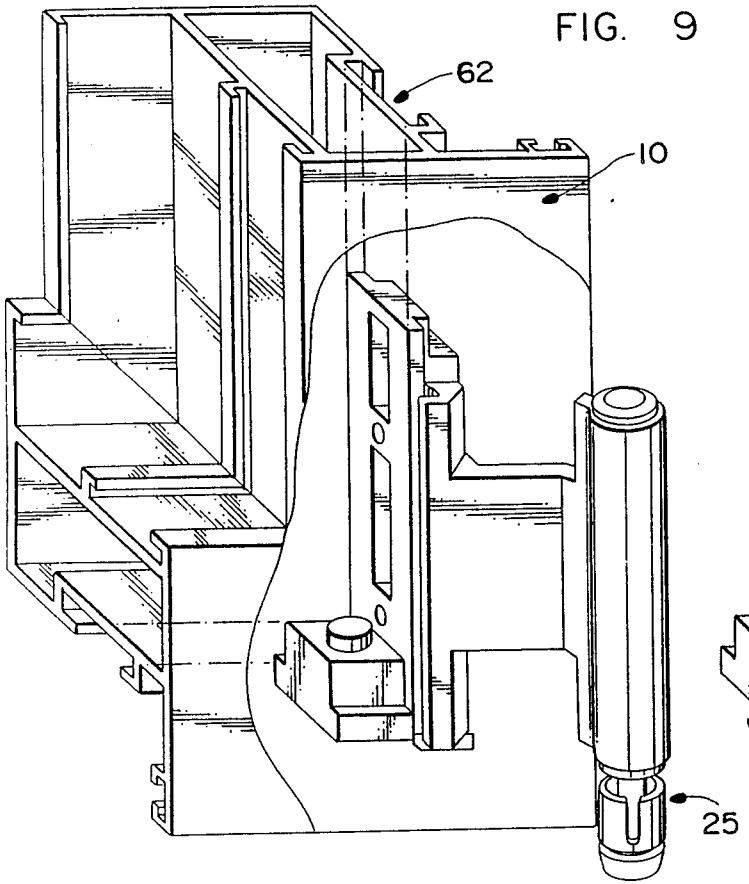
FIG. 9 is a perspective view of the jointed part of the angular support attached to the movable frame.

We refer to the various figures.

The fitting according to the invention is used, more particularly, as a joint for a swing-type door, window or the like, built from tubular profile made of metal or plastic material and the movable frame whereof is partly overlapping the fixed frame. More specifically, this movable frame comprises, at its periphery, a border 90 applied, in the closed position, to the inner face 91 of the fixed frame and overlapping the latter partly in this manner.

According to the invention, the fitting consists of an angular support 1 and of a compass bearing 2. The angular support 1 is located generally at the lower end 3 and in the angle of the fixed frame 4 of the door, window or the like. As for the compass bearing 2, it is fitted on the same side as the angular support 1 but in the upper angle 5 of the fixed frame 4.

The angular support 1, just as the compass bearing 2, consists of a fixed element 6, 7 respectively fitted solidly to the fixed frame 4, and of a jointed part 8, 9 respectively. Within the framework of the angular support 1, this jointed part 8 is fitted to the movable frame 10 whereas the jointed part 9 that corresponds to the compass bearing 2, constitutes the means of support for the compass arm 11.

Considering that the present jointed fitting for swing-type designs is fitted to doors, windows or the like, the fixed frame and the movable frame of which are built of profile, the structure thereof should be described in detail.

Thus, according to one form of embodiment widely used by most of the manufacturers, the fillister 92 of this fixed frame and that 93 of the movable frame are profiled in such a manner as to display a T-shaped groove 36, 62 that serves normally for the sliding of the switch rod (not shown in the figures) controlled by a locking device such as a casement bolt or lock/casement bolt.

The angular support 1 and the compass bearing 2 will be designed advantageously for clamping against the fixed frame 4 and for this purpose, their fixed element 6, 7 comprises means designed for fillister-fastening 12, 14 to the aforesaid fixed frame 4.

To note that according to one characteristic feature of the invention, the angular support 1 and the compass bearing 2 are both symmetric in relation to a median horizontal plane 15, 16. This special configuration of the aforesaid angular support 1 and compass bearing 2 confers on them their reversibility for being used either left or right of the movable frame 10, via a simple reversal.

More specifically, the fixed element 6 of the angular support 1 comprises two cylinder-shaped parts 17, 18 arranged on one and the same axial prolongation and located at the ends 19, 20 of mounting plate 21. Each of these cylinder-shaped parts 17, 18 displays at the upper face 22 and at the lower face 23, a central recess 24 that serves as a housing to a swivel joint 25 fitted solidly to the jointed part 8. In order to make the rotation of the swivel joint 25 in the recesses 24 easier, the latter display a bottom 26 of hemispheric shape.

The mounting plate 21 of the fixed element 6 is designed to be fitted to the inner face 104 of the fixed frame 4. For this purpose it comprises on its longitudinal narrow side 29 and at its ends 19, 20 square-shaped wings 30, 31 that constitute the fillister-fastening means 12 to the fixed frame 4 of the angular support 1. Thus, these wings 30, 31 are provided, on the rear face 32 of the wing section 33 arranged in perpendicular to the plane of the fixed frame 4, with a vertical channel 34, the opening 35 of which is oriented in the direction of the outer face of the movable frame 10. This vertical channel 34 co-operates with the T-shaped groove 36 arranged on the fillister 37 of the upright 38 of the fixed frame 4 and is formed by two vertical partitions 39, 40 provided at their free end with angles 41, 42.

The co-operation of the vertical channel 34 of the square-shaped wings 30, 31 and of the T-shaped groove 36 allows for preventing the rotation of the fixed element 6 of the angular support 1 around a vertical axis.

These fillister-fastening means 12 that consist of square-shaped wings 30, 31 of the fixed element 6, also have the function of ensuring a positioning according to a vertical direction of the angular support 1 in relation to the fixed frame 4.

For this purpose, the wing portion 33 of the square-shaped wing 30 is provided on its lower narrow side 43 with a tag 44 capable of co-operating with the T-shaped groove 45 arranged on the lower crossbar 47 of the fixed frame 4. Because of the reversibility of the angular support 1, the square-shaped wing 31 is also provided with a tag 48 that ensures, in the event of a reversal of the angular support 1, a positioning of the latter according to a vertical direction.

In order to maintain the fixed element 6 of the angular support 1 firmly against the fixed frame 4, the wing portion 33 of the square-shaped wings 30, 31 is provided with a hole 49 used as a passage for a fastening element 50 such as a bolt or the like. This fastening element 50 co-operates with a small rule or wedge 51 installed in the T-shaped groove 36 of the upright 38. This small rule or wedge 51 plays the role of a double nut that allows, moreover, for preventing any unexpected release from the vertical channel 34, of the square-shaped wings 30, 31 of the T-shaped groove 36.

During the assembling operation, it is necessary to make sure of a precise positioning of the threaded holes 52 of the small rule or wedge 51 in relation to the fastening elements 50 installed in the holes 49 of the square-shaped wings 30, 31. For this purpose, the aforesaid small rule or wedge 51 comprises in its upper section 53 a prehensile tongue 54 that is projecting in relation to the T-shaped groove 36.

Advantageously and according to another characteristic feature of the invention, the fixed element 6 of the angular support 1 comprises, furthermore, applied fastening means 94 to the inner face 91 of the fixed frame 4. More specifically, the mounting plate 21 is provided at least with one hole 27 used as a passage for a fastening element such as a bolt, rivet or the like, liable to co-operate with the fixed frame 4. Because of the reversibility of the angular support 1, the mounting plate 21 comprises, preferably, at least two holes 27, 28 arranged symmetrically in relation to the median horizontal plane 15.

In the event of a restoration, it is frequent for an opening to exist previously on the inner face 91 of the fixed frame 4 and which opening has served, in the past, for the applied fastening of another joint. Under these conditions, it may be particularly interesting to use this opening again for the purpose of mounting the angular support 1 according to the invention.

This prevents weakening the fixed frame 4 locally in consequence of multiple perforations. With this purpose in mind, the holes 27, 28 may be changed into oblong openings, the length of which is determined so as to cover the range within which normally varies the positioning of the premachined hole in the fixed frame 4.

Where the jointed part 8 of the angular support 1 is concerned, it consists of a knuckle 55, the height of which is slightly less than the clearance 56 that exists between the two cylinder-shaped parts 17, 18 of the fixed element 6. Moreover, the jointed part 8 comprises a blade 57 fitted solidly to the knuckle 55 which constitute, partly, fillister-fastening means 13 to the movable frame 10 of the angular support 1.

Advantageously, the blade 57 of this jointed part 8 displays a height slightly less than the clearance 95 between the square-shaped wings 30, 31 fitted solidly to the mounting plate 21. In this manner and in the closed position of the movable frame 10, this blade 57 and the square-shaped wings 30, 31 are able to find themselves in the same plane and thus decrease their size in relation to the space delimited by the border 90 and the inner face 91 of the fixed frame 4.

Considering that the function of this jointed part 8 is to ensure a rotation around a vertical axis and a rotation around a horizontal axis of the movable frame 10, the knuckle 55 comprises at its lower end 58 a swivel joint 25 engaged in the central recess 24 of the lower cylinder-shaped part 17. When the angular support 1 is reversed, it is necessary to install the swivel joint 25 in the recess 24 of the cylinder-shaped part 18. For this purpose, the knuckle 55 comprises at its ends 58, 59 removable-type fastening means of the swivel joint 25. The latter may consist substantially of a tapped bore into which is screwed a threaded rod fitted solidly to the swivel joint 25.

The fillister-fastening means 13 to the movable frame 10 of the angular support 1 consist, furthermore, of a square-shaped linkage element or wedge 60, the vertical part 61 of which is engaged in the T-shaped groove 62 located on the lateral vertical narrow side 63 of the movable frame 10. To prevent the release of the linkage element 60 from this groove 62, its vertical section 61 is provided with two lateral edges 64, 65 that co-operate with the angles 66, 67 of the vertical partitions 68, 69 that constitute the T-shaped groove 62. This linkage element 60 is fitted solidly to the blade 57 via fastening elements 70. As to the section 71 arranged horizontally of the linkage element 60, it allows for ensuring a vertical positioning of the movable frame 10 in relation to the fixed frame 4 and it comprises, for this purpose, adjusting means 88.

Where the compass bearing 2 is concerned, the fixed element 7 of the latter is formed by a mounting plate 72 provided at its ends 73, 74 with a knuckle 75, 76 that displays a central bore 77. These knuckles 75 are arranged in one and the same vertical alignment in such a manner that the centerline of the bore 77 of the knuckle 75 arranged at the lower end 73 of the mounting plate 72, is in one and the same prolongation as the centerline of the bore 77 of the knuckle 75 arranged at the upper end 74 of the aforesaid mounting plate 72 is concerned.

This fixed element 7 of the compass bearing 2 comprises, furthermore, two wings 78, 79 arranged at the ends 73, 74 of the mounting plate 72 and fitted solidly to the vertical narrow side 80 of the latter. These wings 78, 79 display a configuration largely similar to the square-shaped wings 30, 31 of the fixed element 6 of the angular support 1 and, therefore, constitute the fillister-fastening means 14 to the fixed frame 4 of the compass bearing 2.

Moreover, the fixed element 7 of the aforesaid compass bearing 2 is provided with applied fastening means 96 to the inner face 91 of the fixed frame 4. These fastening means are formed by two holes 81, 82 at least that are arranged symmetrically in relation to the horizontal median plane 16 and that are used as a passage for a fastening element such as a bolt or the like.

Just as for the mounting plate 21 of the fixed element 6 of the angular support 1, the holes 81, 82 of the mounting plate 72 may be replaced by oblong openings that allow for vertically adjusting the compass bearing 2 in relation to the fixed frame 4. These oblong openings also have the function of conferring on the compass bearing 2 its polyvalent nature in view of being adapted, in the event of a restoration, to doors or windows fitted initially with different joints.

Because of the load brought to bear on the compass bearing 2, the knuckles 75, 76 may also comprise such holes 83, 84 or oblong openings used as a passage for additional fastening elements so as to strengthen the linkage between the compass bearing 2 and the fixed frame 4.

The jointed part 9 of the compass bearing 2 consists of a knuckle 85, the height of which is slightly less than the clearing 86 that exists between the knuckles 75, 76 of the fixed element 7. This knuckle 85 is provided with a central bore into which is engaged a pin, the ends of which are installed in the bores 77 of the knuckles 75, 76. This pin ensures the rotation according to a vertical centerline, of the jointed part 9 in relation to the fixed element 7. The aforesaid jointed part 9 comprises, furthermore, a blade 87 fitted solidly to the knuckle 85 and that functions as a support for the compass arm 11. Advantageously, the height of this blade 87 is slightly less than the clearing 97 that exists between the square-shaped wings 78, 79 that are fitted solidly to the mounting plate 72. This arrangement is substantially similar to that used in the framework of the angular support 1 and it displays, for this reason, the same feature of interest that consists in decreasing the size of the compass bearing 2 at the level of the space delimited by the border 90 of the movable frame 10 of the inner face 91 of the fixed frame 4.

Apart from the reversibility and the improved mechanical resistance of the jointed fitting, this invention provides an additional advantage that consists in the standardization of the manufacturing process for the angular support 1 and the compass bearing 2. The latter are, as a matter of fact, of one and the same structural design which allows for them to be executed, moreover, on the basis of one and the same material.

Thus, the fixed elements 6, 7 of the angular support 1 and of the compass bearing 2 are made from one and the same profile, the machining of which allows for obtaining either the cylinder-shaped parts 17, 18 or the knuckles 75, 76 and the square-shaped wings 30, 31 or 78, 79.

What is claimed is:

1. Jointed fitting for a movable member such as a swing door, window or the like designed in metal or plastic material profile and having a movable frame which partly overlaps a fixed frame having an inner face and an inner channel arranged substantially perpendicular to said inner face, said fitting comprising an angular support and a compass bearing both being symmetrically arranged in relation to a median horizontal plane which allows for their reversibility for being used either on the right or left side of the movable member, and comprising fixed elements being adapted to be fitted solidly to the fixed frame, and jointed parts being adapted to be fitted to the movable frame or used as a support for the compass bearing, with the fixed elements comprising fillister-fastening means including one portion for attachment to the inner face of the fixed frame and another portion cooperating with said channel of said fixed frame.

2. The jointed fitting of claim 1, comprising an angular support that comprises a jointed part and a fixed element, with the latter comprising two cylinder-shaped parts arranged at the ends of a mounting plate and located along the same axis, with said cylinder-shaped parts co-operating with jointed means that are fitted solidly to the jointed part.

3. The jointed fitting of claim 1, comprising an angular support provided with a fixed element that includes a mounting plate comprising, at one of its longitudinal narrow sides, two wings that constitute said fillister-fastening means which are to be attached to the fixed frame of the said angular support, with said mounting plate including at least one opening used as a passage for a fastening element adapted for connection with the inner face of the fixed frame.

4. The jointed fitting of claim 1, comprising an angular support provided with a fixed element that includes a mounting plate provided with at least two openings arranged symmetrically in relation to the median horizontal plane, with these openings serving as a passage for fastening elements and constituting the fastening means of the fixed element to the inner face of the fixed frame.

5. The jointed fitting of claim 2, comprising an angular support that comprises a fixed element and a jointed part, with the latter formed by a knuckle of a height that is slightly less than the clearance between the two cylinder-shaped parts of the fixed elements, and by a blade fitted solidly to said knuckle and further comprising fillister fastening means adapted to be connected to the movable frame, with said knuckle provided at its end with removable fastening means.

6. The jointed fitting of claim 3, comprising an angular support that comprises a jointed part comprising a knuckle and a blade, with the height of the blade being slightly less than the clearance between the wings of said fixed element so as to be positioned in the same plane as said mounting plate when the movable frame is closed.

7. The jointed fitting of claim 1, comprising a compass bearing comprising a jointed part and a fixed element, a mounting plate being provided with fillister fastening means for attachment to the fixed frame, said fillister fastening means comprising two bent wings and fitted to one of the longitudinal edges of said mounting plate.

8. The jointed fitting of claim 1, comprising a compass bearing that comprises a fixed element provided with a mounting plate fitted with fastening means for connection to the fixed frame, with said fastening means comprising at least two openings arranged symmetrically in relation to the median horizontal plane and that are used as a passage for fastening elements.

9. The jointed fittings according to claim 7, comprising a compass bearing provided with a jointed part that comprises a knuckle, the height of which is slightly less than the clearance between the knuckles of the fixed element, and a blade fitted solidly to the knuckle, said blade being a height slightly less than the clearance that exists between said wings, with said blade providing for the support of the compass bearing.

10. The jointed fitting of claim 7, said fixed element comprising knuckles, each of which are provided with an opening used as a passage for a fastening element for fastening the compass bearing to the fixed frame.

11. The jointed fitting of claim 3, said wings comprising means for positioning the angular support and the compass bearing in a vertical direction, with these means adapted to cooperate with the fillister of the fixed frame.

12. The jointed fitting of claim 7, said wings being bent and which comprise means for positioning the angular support and the compass bearing in a vertical direction, with these means adapted to cooperate with the fillister of the fixed frame.

13. The jointed fitting of claim 1, comprising an angular support provided with fixed elements that each display a mounting plate provided with oblong openings arranged symmetrically in relation to the median horizontal plane, with said oblong openings serving as a passage for fastening elements and constituting the fillister-fastening means of the fixed elements to the inner face of the fixed frame.

14. The jointed fitting of claim 1, comprising a compass bearing that comprises a fixed element provided with a mounting plate fitted with the fillister-fastening means to the fixed frame, with said fastening means comprising oblong openings arranged symmetrically in relation to the median horizontal plane and that are used as passages for fastening elements.

15. The jointed fitting of claim 10, the knuckles of the fixed element each being provided with an oblong opening used as a passage for a fastening element for fastening the compass bearing to the fixed frame.

* * * * *